United States Patent [19]

Hamann

[11] Patent Number: 4,512,276

[45] Date of Patent: Apr. 23, 1985

[54] SAILBOARD RIG

[76] Inventor: Georg Hamann, Loherfeldweg 8, 8211 Schleching, Fed. Rep. of Germany

[21] Appl. No.: 531,677

[22] Filed: Sep. 13, 1983

[30] Foreign Application Priority Data

Sep. 17, 1982 [DE] Fed. Rep. of Germany ..... 3234582

[51] Int. Cl.[3] ..... B63B 35/72

[52] U.S. Cl. ..... 114/39; 114/90

[58] Field of Search ..... 114/39, 102, 103, 97, 114/90, 39.2, 43; 441/74; 280/213; 244/153 R

[56] References Cited

U.S. PATENT DOCUMENTS

| | | | |
|---|---|---|---|
| 634,386 | 10/1899 | Zimmerman | 244/153 R |
| 4,077,345 | 3/1978 | Gurley | 114/102 |
| 4,296,704 | 10/1981 | Bridge | 244/153 R |

FOREIGN PATENT DOCUMENTS

| | | | |
|---|---|---|---|
| 3100283 | 8/1982 | Fed. Rep. of Germany | 114/39.2 |
| 7710205 | 3/1978 | Netherlands | 114/39.2 |
| 8002427 | 11/1981 | Netherlands | 114/39.2 |
| 2101947 | 1/1983 | United Kingdom | 114/39.2 |

*Primary Examiner*—Trygve M. Blix
*Assistant Examiner*—Jesûs D. Sotelo
*Attorney, Agent, or Firm*—Orrin M. Haugen; Thomas J. Nikolai; Douglas L. Tschida

[57] ABSTRACT

A sailboard rig has a mast and a boom running aft from the mast for holding and moving the sail. The boom is more specially in the form of a wishbone boom with the sail in its opening. The mast has a mast foot joint such that it may be turned and heeled over on the board. The sail is joined to the mast at its luff and the aft end of the boom is joined with an aft limit of the sail.

In order to make possible better use of the wind and for increasing the top speed of the rig, the sail is made up of a lower panel and two upper panels and the mast is branched so as to have two upper arms spreading outwards towards leeches of the two upper panels of the sail. These upper panels are joined with the lower sail panel at a seam and are joined to the mast arms along luffs so that all in all there is a generally Y-like mast and a sail with a Y-like form of luff.

8 Claims, 8 Drawing Figures

SAILBOARD RIG

BACKGROUND OF THE INVENTION

The present invention is with respect to a rig for a sailboard and more specially to such a rig having a mast and a wishbone or other boom for holding and changing the position of the sail that is held within the two sides or spars of the boom, the mast being without any stays so that it may be freely heeled and turned about a mast foot joint. The mast is joined with the luff of the sail forward while the clew is joined with the aft end of the wishbone boom.

DISCUSSION OF THE PRIOR ART

An example of a rig as widely used for board sailing is to be seen in the German Patent No. 1,914,604. This rig has a sail stretched out between the mast and the aft end of the boom and the mast may be turned about a more or less upright axis and furthermore heeled over rocked about the mast foot in relation to the sailboard and the wind. The form of sail normally used for such a sailboard is three-cornered with the luff joined to the mast. The clew is joined with the aft end of the boom by an outhaul. The wishbone boom is joined to the mast at its forward end some distance over the tack so that the sail is kept in position loosely stretched out between the mast and the boom head and between the two sides of the boom, the sail foot running down at an angle from the aft end of the boom to the tack at the mast.

In this known rig however only small changes may be made in the size of the sail because of the limiting effect of the mast and the aft end of the boom. Because of this at a given wind force the top speed and the highest forward thrust are limited.

Furthermore rig designs are known in which the sail has battens near the head of the sail for increasing the sail area somewhat. However, this does not make it possible to make any very much better use of the wind.

GENERAL OVERVIEW OF THE INVENTION

On the other hand one purpose of the present invention is that of designing a sailboard rig that makes it possible for much better use to be made of the wind.

A further purpose or object of the invention is to make possible sailing at a higher speed at a given strength of the wind.

For effecting these and other purposes, in the present invention the mast is generally Y-like with a lower mast section running up from the mast foot joint to a branch point and then further upwards in the form of two outwardly forked mast arms, the sail having a lower sail panel and two upper, outwardly and upwardly spreading panels in keeping with the Y-like form of the mast, and with a Y-like luff, the two upper sail panels being joined with the lower panel along a seam running to an aft limit of said sail.

In keeping with a further development of the invention the boom is in the form of a wishbone boom and near their aft ends the two spars of the boom are branched each into upper and lower sections, the two lower sections being joined together at the aft edge of the sail and the two upper sections being joined together at the said sail edge, the leech of the sail running to the joining point of the top sections and the sail foot running towards the point at which the lower sections are joined together. In this case the sail is generally trapezoidal. Further forms of the invention are detailed in the dependent claims.

The present invention makes possible a completely new form of sailboard rig, with which a sailboard may be sailed at a markedly higher speed under a light breeze or with a heavy wind than has been possible with prior art sailboards in these two different conditions. This is made possible by the Y-like mast running a three part sail. In other words the sail area is increased by having two upper spaced sail panels. At more or less all settings of the sail in relation to the wind the force thereof may be very much better profited from inasfar as the wind coming in at an angle to the sail area takes effect on the lee sail part as well so that the forward force is increased. It is only when the wind is from aft that the sail part that is further aft will be in the wind shadow of the other part and no better use may be made of the wind. If the board is sailed with the rig heavily heeled over into the wind the mast arm on the lee side will be in a more upright position than when the mast is generally upright so that this will be a reason for the forward force being increased. Because in this position of the sail the diverging mast arm on the windward side will be lowered towards the water, in this heeled over position the upthrust force acting on the board will be increased so that the board will be kept higher up in the water and the speed increased. In fact such upthrust forces produced by the rig and taking effect on the board will make it possible for the board user to get his board to jump over waves and to come completely clear of the water for short distances.

On the other hand the very much larger sail area made possible by the invention will make for a smaller size of the mast, the wishbone boom, and the parts of the sail. This in turn makes for a lower center of gravity of the rig so that it is nearer the board, the rig and the board then being more, very much more readily handled than with a prior art rig. It is more specially, because of the shorter boom, then made possible that the danger of breakage thereof is decreased and the weight of the system generally is cut down.

A further useful effect produced in this respect is that the sail may not be blown out to the lee so much or is less baggy.

In keeping with the preferred form of the invention in which the aft ends of the spars of the boom are branched out into lower and upper sections at whose ends the sail is fixed, it is possible to have a markedly larger sail area than in the prior art and the forward force is greater. More importantly, however, because the sail is rigidly made fast to the two aft ends of the boom branching out from each other, it is possible to make certain that the leech of the sail is not overly blown out of place by the force of the wind.

In keeping with a still further development of the invention the angle between the two outwardly branching mast arms may be adjusted, that is to say the two arms may be fixed in relation to each other at different angles as desired so that the sail may be trimmed to be in keeping with the strength of the wind blowing at a given time so as to get the greatest upthrust and forward forces.

In line with one further development of the invention the boom is in the form of a spar having its forward end supported on the mast, as for example at the point of branching thereof where there is a support member for the separate mast sections or arms. This spar is placed right over the seam joining the lower sail panel with the two top panels. The sail is able to be trimmed at the end furthest from the mast. This makes certain that there is no chance of the sail blowing out as far as has been the case with the prior art so far even when sailing under a heavy weather. Furthermore on the two sides of the spar there may be outer sail holding parts, that are not stiff like the spars of a true wishbone boom but are in the form of a partly elastic or fully elastic grips or grip members hanging down for example like loose rope. This rope is made fast and trimmed at one end to the mast, preferably at the level of the branch point, and at the other end on the aft end of the spar. It will be seen from this that the sail is trimmed and pulled tight at the luff on the mast and at the clew at the aft end of the sail in the form of single- or two-point tightening system on the spar.

Further useful effects and details of the invention will be seen from the account now to be given of the working examples to be seen in the figures herein.

LIST OF THE DIFFERENT VIEWS OF THE FIGURES

FIG. 1 is a diagrammatic view of the rig in keeping with the present invention as seen in perspective.

FIGS. 2*a* to 2*c* are diagrammatic bows-on views of the rig of the invention at different angles of heel.

DETAILED ACCOUNT OF WORKING EXAMPLES OF THE INVENTION

Figure 1:
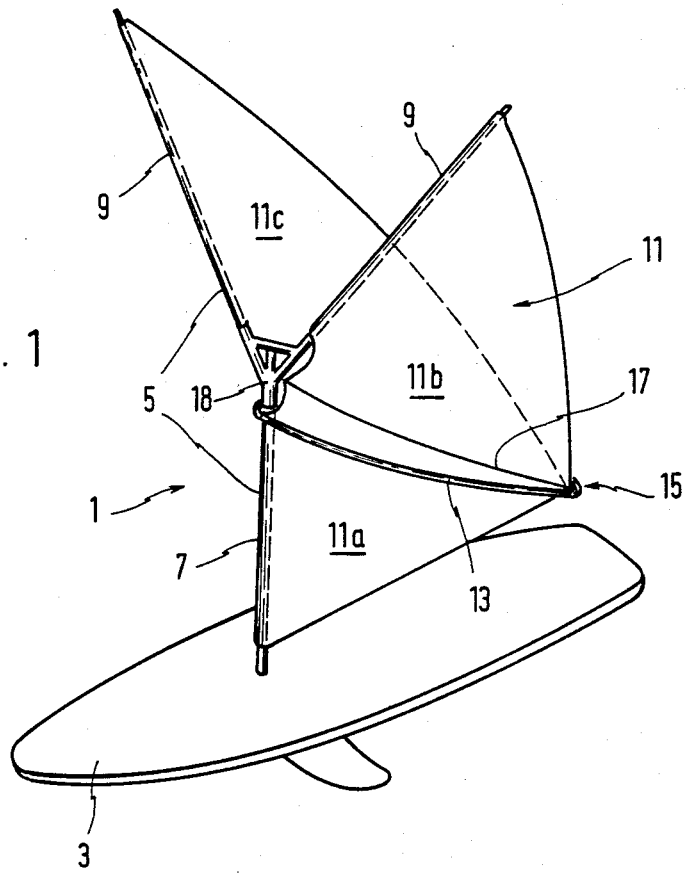

In FIG. 1 the reader will see a rig 1 on a sailboard 3. The rig is made up of a mast or forked mast 5, that has a lower, single mast section 7 and two top outwardly forked or branched mast sections or arms 9. The sail is in the form of a double or tri-sail 11, that is made up of a lower sail section or panel 11*a* and two sail panels 11*b* and 11*c* joined together at the top edge of the lower panel. Not only the lower sail panel 11*a*, but furthermore the two upper sail panels, placed side by side in the form of a letter V, 11*b* and 11*c* have their luffs fixed to the mast 5 by way of a mast sleeve for example.

The boom is in the present case in the form of a wishbone boom 13 having its forward end joined to the mast in a known way by lengths of line. At the aft end 15 of the boom 13 the sail 11 is made fast by an outhaul. The joint between the lower sail panel 11*a* and the two upper sail panels 11*b* and 11*c* is in this case in the form of a seam 17 on a level with the boom. The boom is fixed at a normal height on the mast, this being the height at which the mast is branched; that is to say, the mast is made up of a lower part 7 and two outwardly forked mast arms 9. The rig is joined to the board by way of a mast foot joint (not figured) without any stays so that it may be heeled over and turned about its own axis as necessary to keep the sail under control using the boom that is held in the hands.

As is to be diagrammatically seen in FIG. 1 and as will be made clear in more detail later, there is a support part at the connection between the lower mast section 7 and the two upper outwardly sloping mast arms 9, the support part keeping the two mast sections or arms 9 at a fixed angle therebetween, which however may be adjusted. Furthermore the mast 5 may be so designed that it may be bodily adjusted in height.

Figure 2A:
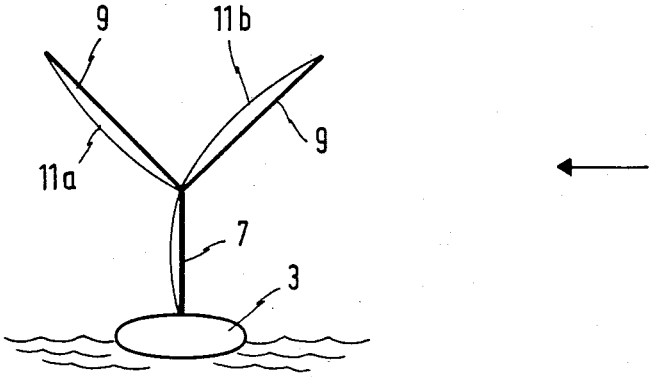

An account will now be given in detail of the function of the rig 1 using the FIGS. 2*a* to 2*c*.

In each of these figures the rig will be seen diagrammatically, sailing towards the reader. In FIG. 2*a* the basic position will be seen in which the lower mast part 7 is more or less upright and at a right angle to the water surface, the two upper, outwardly branching mast arms 9 having an angle of 60° to 100° and more specially 90° between them. In this position as well with only a medium wind the double form of the top part of the sail has the effect of greatly increasing the sail area and in fact in all settings of the sail in which the wind is acting at an oblique angle on the sail, the wind pressure will as well take effect on the sail section on the lee side as well so that the forward force will be increased.

Figure 2B:
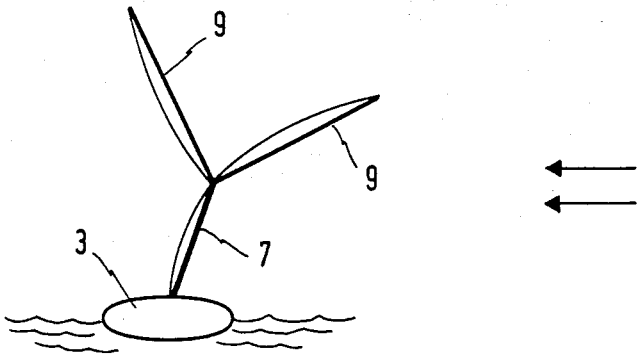
Figure 2C:
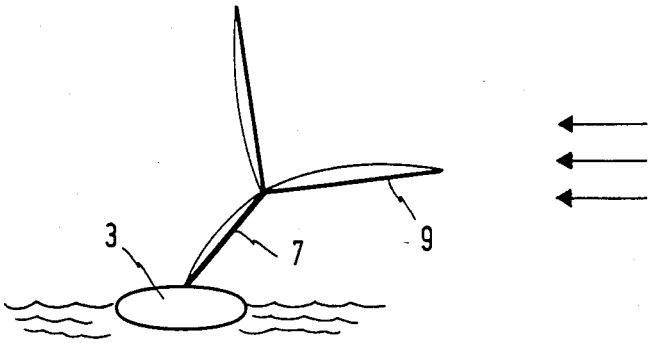

In FIGS. 2*b* and 2*c* the position of the sail under a stronger wind is to be seen diagrammatically. It will be clear from this that even when sailing in the strongest wind and with such a very large heel angle of the mast the lee sail panel is kept upright so as to be responsible for producing a very powerful forward force. Stated differently, because the sail panel 11*b* on the lee side is in a more or less completely upright position offering the largest possible surface for the wind to take effect on, the maximum forward thrust is produced. The sail panel 11*c* on the windward side, that with this very great angle of heel is moved further and further downwards towards the surface of the water, is responsible for producing very strong upthrust forces that take effect on the board 3 by way of the rig 1 so that this form of the invention is responsible for producing the very greatest possible forward and upthrust forces as well as in the case of a hang-glider. For this reason the wetted area of the board is cut down and, more specially, wave jumping will be possible.

Figure 3:
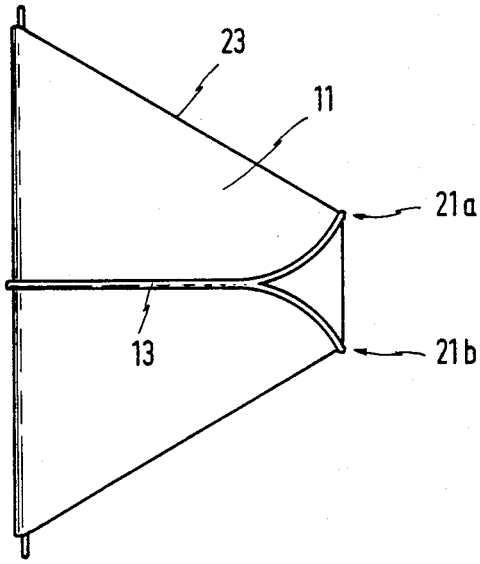
FIG. 3 is a view of boom forming part of the invention with a branching aft end made in two sections.

FIG. 3 is a diagrammatic view of a further possible form of rig as seen from the side with one sail. The wishbone boom 13 is in this case designed with spars branching at their aft ends 21*a* and 21*b* and not unbranched and in the form of a simple oval as is normally the case. This makes it possible for the sail area, even in the case of a single sail, to be markedly increased inasfar as the leech 23 of the sail is higher up and the sail foot 25 running to the lower end 21*b* may be at a lower level, the sail being cut straight between the upper "clew" and lower clew so as to be generally parallel to the lower mast section 7.

Figure 4:
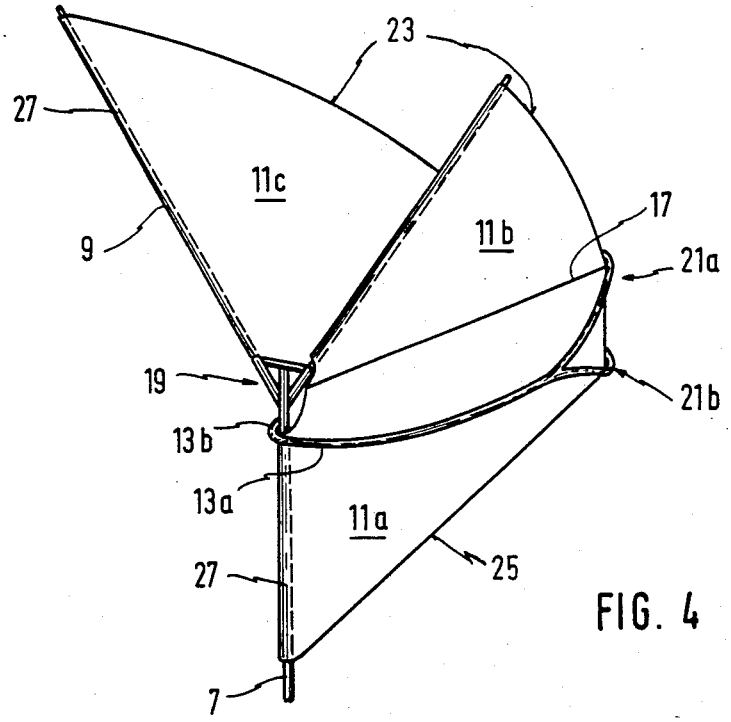
FIG. 4 is a view of a further working example of the rig in keeping with the present invention.

In FIG. 4 the reader will see a further development of the invention uniting the useful effects of the systems of FIGS. 1 and 3 together, that is to say with a forked mast and three sail panels 11*a* to 11*c*, the seam 17 running from the forward point at which the boom is made fast on the mast 5 to the aft top end 21*a* of the boom 13. In a way different to the system to be seen in the figure it is however possible for the branching of the two aft ends not to be symmetrical to the plane of the two boom spars 13*a* and 13*b* and in fact it may be such that the lower spar end 21*b* is in the same plane as the spars 13*a* and 13*b* and it is only the top end 21*a* that is out of (that is to say, higher up than) this plane.

Figure 5:
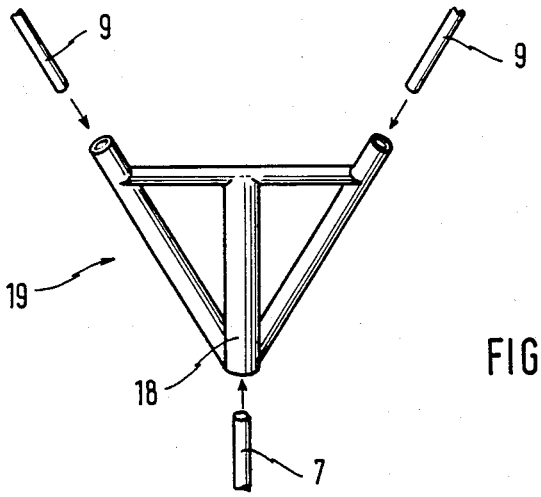
FIG. 5 is a diagrammatic view of the support member between the outwardly forked upper arms and the lower mast part.

In FIG. 5 the holding member 19 for holding and supporting the two mast arms 9 on the mast lower section 7 is furthermore to be seen diagrammatically.

When the rig is put together or taken to pieces the two outwardly branching mast arms 9 are threaded through (or slipped out of) the luff sleeves 27 on the top sail panels 11*b* and 11*c* and the arms are then fixed to the holding member 19. The lower mast section 7 is as well threaded into a sleeve 27 and locked in the holding member 19. This being done, the sail is then tensed using outhauls on the spar end or ends 21*a* and 21*b*.

In this respect the design of the holding member 19 may be such, more specially, that the angle between the two upper mast arms and the height of the mast generally may be adjusted, although this is not to be seen in the figures.

The sailboard is used like the well-known forms of board and rig. The sail is lifted up out of the water with a known form of inhaul fixed to the branch point of the mast.

As one change possible in the design of the rig figured here, the mast may be V-like, the two panels 11*b* and 11*c* running down to a common sail foot without any common sail panel 11*a*. Because in their lower parts the panels only have a small distance between them, the use of the wind is not very much more efficient.

Furthermore in the working example to be seen in FIGS. 1, 2 and 3 the three sections of the mast are in a single plane, although they may be bent out of it to some degree. However the two outwardly branching arms of the mast may be put at a slope somewhat so as to be running aft from the top of the lower mast section, the top sail panels 11*b* and 11*c* then, when looked down upon, being like the wings of a hang-glider.

Figure 6:
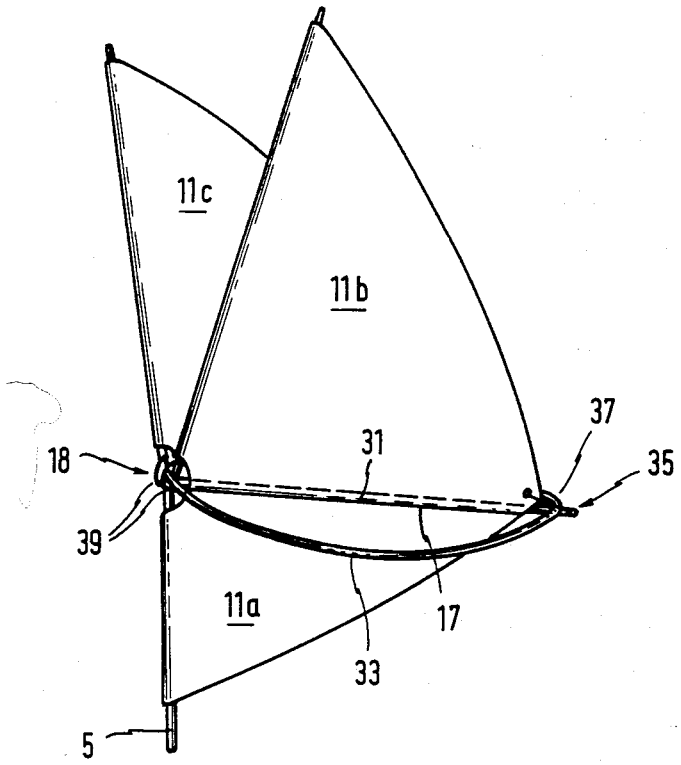
FIG. 6 is a diagrammatic side view of the rig with one sail sprit and elastic or semi-elastic grip members for the boom.

Turning lastly to the further form of the rig as in FIG. 6, that is to be seen on the port quarter, it is here again a question of a sail with a single common lower panel 11*a* and the two upper panels 11*b* and 11*c*.

This form of rig has a spar 31 running, as roughly marked in the figure, from the branch point 18 of the mast 5 (at which its fixed or joined by way of a moving joint for example) to its aft end 35 that is joined to the clew of the sail by an outhaul and a cringle. The spar 31 is placed right over the seam 17 between the two outwardly and upwardly spreading sail panels 11*b* and 11*c* or halves. This system makes certain that there will be no such strong billowing or blowing out of the sail as is the case with known designs, while on the other hand the sail is tensed by the spar 3 only. It would furthermore be possible for the spar to be in the form of a sprit taken up in a sleeve in the sail. In this case the sprit 31 may have freely swinging or loosely hanging, festoon-like grip members 33 that are partly or completely elastic in nature. The grip members will be joined at their forward ends to the mast, more specially at the branch point thereof, and joined at their aft ends to the aft end 35 of the sprit, for example by a piece of line. It will be seen that the grip members are not in this case in the form of outwardly curved, stiff spars like the sides of a wishbone boom, but in the form of lengths of material, hanging down between their aft and forward ends, to the two sides of the sail panel 11*a*.

If each grip member 33 is made at least partly elastic, it may be generally U-like, the open end of the grip member 33 possibly having, for example, two semi-circular support loops 39 so that the grip member 33 may simply be hooked inwards round the mast arms 9 at the branch point 18. The opposite end of the U-like structure 37 may be joined, for example by lashing, to the aft end 35 of the sprit, this making it simpler for the rig to be put together and the sail set and furled. The sprit 31 may be designed so that it may be unjoined from the mast 5 or the holding member 19. However it would furthermore be possible to have a universal joint connection here so that after taking down the sail the sprit might be folded away against the mast to take up less space.

I claim:

1. A sailboard rig comprising a mast, a sail, a boom for holding and moving the sail, a mast foot joint for connection of said mast to a sailboard so that said mast may be turned and heeled over, said sail being joined with said mast at a sail luff and with an end of said boom spaced from said mast, said mast being generally Y-like with a lower mast section running up from said mast foot joint to a branch point and then further upwards in the form of two outwardly forked mast arms, said sail having a lower sail panel and two upper, outwardly and upwardly spreading panels in keeping with the Y-like form of the mast and a Y-like luff, the two upper sail panels being joined with the lower panel along a seam running to an aft limit of said sail.

2. The rig as claimed in claim 1 wherein the said boom is joined to said mast at said branch point.

3. The rig as claimed in claim 2 in which the plane of symmetry of the boom running in the length direction thereof with the spars on the two sides thereof is normal to a plane containing the outwardly forked mast arms.

4. The rig as claimed in claim 2 wherein said boom is in the form of a spar running from the branch point of the mast, at which it is supported, along said seam joining said lower sail panel to said upper sail panels, and as far as an aft limit of said sail, said rig further having means for adjustably tensing said sail from the aft end of said spar.

5. The rig as claimed in claim 4 having grip members on the two sides of said spar for holding and steering said sail, said grip members being at least partly elastic and being joined to said mast at said branch point thereof.

6. The rig as claimed in claim 1 wherein said mast branches have an angle between them of 90°.

7. The rig as claimed in claim 1 comprising a holding member on said mast branch point such that said mast arms may be unjoined from each other and from said mast lower section.

8. The rig as claimed in claim 1 wherein said boom is in the form of a wishbone boom made up of two spars on two sides of the mast, said spars branching near aft ends thereof into lower and upper branch sections with the upper and lower sections of one spar being generally in one upright plane, said sail being generally trapezoidal with an upper leech running to a point of connection at the aft ends of said upper spar sections and a sail foot running to a point of connection at the aft ends of said lower spar sections, said seam running from said mast branch point to said point of connection of said upper spar sections.

* * * * *